US005544423A

United States Patent [19]

Westelaken

[11] Patent Number: 5,544,423

[45] Date of Patent: Aug. 13, 1996

[54] GAS DISTRIBUTOR

[76] Inventor: Christianus M. T. Westelaken, P.O. Box 1349, Grand Bend, Ontario, Canada, NOM-ITO

[21] Appl. No.: 353,072

[22] Filed: Dec. 9, 1994

[51] Int. Cl.[6] ..... F26B 17/12

[52] U.S. Cl. ..... 34/174; 34/175

[58] Field of Search ..... 34/167, 168, 174, 34/175, 178; 454/175, 179, 180, 181

[56] References Cited

U.S. PATENT DOCUMENTS

| | | | |
|---|---|---|---|
| 361,126 | 4/1887 | Borland et al. | 34/174 |
| 638,429 | 12/1899 | Tweedale et al. . | |
| 691,209 | 1/1902 | Tweedale et al. . | |
| 759,527 | 5/1904 | Irwin . | |
| 2,078,515 | 4/1937 | Sutherland | 34/34 |
| 2,529,953 | 11/1950 | Malecek | 34/65 |
| 2,941,310 | 6/1960 | Schaub | 34/174 |
| 3,010,806 | 11/1961 | Berry | 23/288 |
| 3,175,302 | 3/1965 | Retali et al. | 34/174 |
| 3,447,338 | 6/1969 | Smith, Jr. | 62/374 |
| 4,141,155 | 2/1979 | Benzon | 34/34 |
| 4,398,356 | 8/1983 | Westelaken | 34/65 |
| 4,404,756 | 9/1983 | Noyes | 34/65 |
| 4,423,557 | 1/1984 | Westelaken | 34/56 |
| 4,424,634 | 1/1984 | Westelaken | 34/167 |
| 4,502,229 | 3/1985 | Kitzman | 34/56 |

FOREIGN PATENT DOCUMENTS

| | | | |
|---|---|---|---|
| 524688 | 5/1931 | Germany | 34/174 |
| 1001892 | 3/1982 | U.S.S.R. | 454/180 |

*Primary Examiner*—F. Daniel Lopez
*Attorney, Agent, or Firm*—Luedeka, Neely & Graham, P.C.

[57] ABSTRACT

The specification relates to a gas distributor for an inlet gas plenum comprising a plurality of spatially separate gas deflectors, each deflector arranged and positioned to successively cut diagonally across a gas flow path in a gas flow direction from an inlet end of the distributor to a terminal end of the distributor. The deflectors configured to direct gas flow exiting the distributor in an essentially perpendicular direction to the direction of gas flow entering the distributor.

21 Claims, 5 Drawing Sheets

GAS DISTRIBUTOR

FIELD OF THE INVENTION

The invention relates to gas distributors and in particular to improved gas distributors for use in drying particulate material.

BACKGROUND

The drying of large quantities of particulate or powdery material to a desired moisture content is difficult especially for heat sensitive materials such as grain. Without uniform drying, degradation of heat sensitive materials may occur in the hot areas of the dryer, while other areas of the dryer may not sufficiently dry the particulate material without prolonged drying times. There is a balance therefore between the drying time and the drying temperature that is used to dry the particulate material that must be met, particularly if the particulate material is prone to degradation from overheating. For example, if grain is heated too quickly and then quickly cooled during the drying operation, the sudden temperature changes may tend to cause stress cracking and shattering of the grain. Such cracking or shattering of the grain greatly lowers the value of the grain such that it may not be acceptable to many grain elevators and processors.

In some instances, uniformity of the moisture content of the dried particulate material is also important. Excessive moisture in a portion of the particulate material after drying may present problems with handling, particularly if the material is prone to agglomeration in the presence of moisture. Furthermore, the presence of undesirable moisture may increase the corrosion rate of storage vessels containing particulate materials such as halogenated catalysts and the like. In all of the above examples, uniform drying of particulate material to a desired moisture level is an important consideration.

Many systems have been developed over the years which are intended to heat and uniformly dry particulate material such as grain while at the same time avoiding problems associated with drying heat sensitive materials. One such system is the cross-flow column type particulate dryer in which a heated gas is forced mainly in a transverse direction through a downward moving bed of particulate material to dry the material. Typically the hot gas enters the dryer from an inlet side and travels from the inlet gas side to an opposing side of the dryer while at the same time passing through a foraminous wall into the particulate material to be dried. One means for distributing the gas from the inlet side to the opposing side of the dryer is generally disclosed in U.S. Pat. Nos. 4,398,356; 4,423,557; and 4,424,634 to Westelaken.

Counter flow drying systems have also been used to dry particulate materials. In this case, heated gas is forced through the particulate material in a direction opposite to the direction of flow of the material through the dryer. This method of drying, however, may result in overdrying the material near the hot gas inlet thus leading to product degradation. While counter flow dryers may be more efficient overall, they are not well suited to the drying of heat sensitive materials.

Another type of dryer that may be used for heat sensitive materials is the concurrent-countercurrent flow dryer in which heated gas travels through the particulate material in the same direction as the moving bed of particulate material and a countercurrent flow of cooling gas travels in a direction opposite to the direction of flow of the particulate material. In this system, gas exhaust means may be provided intermediate the hot gas inlet and cooling gas inlet of the dryer. With such a system, the hottest gas is available at a point in the dryer wherein the particulate material is the wettest and coolest. As the particulate material and hot gas travel together, the gas heats and dries the particulate material while the particulate material gradually cools the gas. The counter flow of cooling gas serves to further cool and temper the particulate material before it reaches the outlet of the dryer.

A particular useful concurrent-countercurrent flow dryer for particulate material is disclosed in U.S. Pat. No. 4,086,708 to Westelaken. In the Westelaken system, the efficiency of the dryer is based, at least in part, on the use of drying temperatures in excess of 500° F. (260° C.) near the hot gas inlet. Accordingly, careful control over the flow of particulate material and hot gas are essential to obtain a uniform rate of particulate drying across the drying chamber. Any blockages in the flow of the particulate material or channeling of the gas in the bed of particulate material must be avoided, particularly for heat sensitive materials.

With all of the above, distribution of a drying gas such as air, is a particular problem for large scale particulate dryers. In a large scale particulate dryer, the drying gas may have to travel an extended distance from the inlet gas plenum to the opposing side of the dryer. Distribution of the drying gas evenly throughout the particulate material becomes increasingly more difficult the greater the distance the gas must travel prior to contacting the particulate material to be dried. Smaller dryers which may have the ability to more readily distribute the drying gas, do not provide the drying capacity and thus economies of scale that larger dryers provide.

It is therefore one object of the invention to provide an improved inlet gas distributor for a particulate dryer.

It is another object of the invention to provide an inlet gas distributor for evenly distributing gas diagonally across a path of gas flow so that the gas will more efficiently contact particulate material to be dried in a particulate material dryer.

Still another object of the invention is to provide a plurality of gas deflectors arranged diagonally across a path of longitudinal gas flow for evenly distributing a gas along the longitudinal path of gas flow so that the gas exiting the distributor is directed in an essentially perpendicular direction to the direction of gas flow entering the distributor.

These and other object of the invention will be evident from the ensuing description and appended claims.

SUMMARY OF THE INVENTION

Having in mind the foregoing objects, the invention provides, in one embodiment, a unique gas flow distributor for an inlet gas plenum. The gas flow distributor comprises a plurality of spatially separate gas deflectors, each deflector arranged to successively cut diagonally across a gas flow path in a gas flow direction from an inlet end of the distributor to a terminal end of the distributor. The deflectors preferably direct the gas flow exiting the distributor in an essentially perpendicular direction to the direction of gas flow entering the distributor.

In a preferred embodiment, the distributor further comprises first and second rigid elongate member, each member having inlet ends and terminal ends. The first and second elongate members are disposed in separate diagonally oriented planes relative to the gas flow direction so that the planes intersect at the terminal ends of each member and diverge at the inlet ends of each member. Gas deflectors are disposed in spatially separate positions along each rigid elongate member from the inlet end to the terminal end of each rigid member.

In yet another preferred embodiment, the deflectors are arcuate members. The arcuate members preferably form a 90° arc of a circle and may be disposed from the inlet end to the terminal end such that the spacing between adjacent deflectors provides a continuum of gas flow deflection in a direction perpendicular to the direction of gas flow. Accordingly, the spacing between adjacent deflectors is a function of the length of each deflector and the length and width of the gas flow distributor.

BRIEF DESCRIPTION OF THE DRAWINGS

The above and other features and advantages of the invention will be described in further detail in the ensuing detailed description of a preferred embodiment in conjunction with the accompanying drawings in which.

DETAILED DESCRIPTION

A particular advantage of the invention is the ability to evenly distribute a drying gas in a large scale particulate dryer without the need for an elaborate system of adjustable dampers. Accordingly, the mechanical problems associated with adjustable dampers handling moist gas streams is greatly reduced by use of the distributor of the invention.

In a preferred embodiment, the invention provides a dryer for particulate material containing the gas distributor of the invention. The dryer comprises a chamber for particulate material having a particulate material inlet, a particulate material outlet, a drying gas inlet and an exhaust gas outlet. The drying gas inlet contains a proportioning gas distributor for distributing drying gas along a longitudinal path from an inlet end to a terminal end of the distributor. Preferably, the distributor is formed from a plurality of spatially separate gas deflectors, each deflector arranged to successively cut diagonally across a gas flow path in a gas flow direction from the inlet end of the distributor to the terminal end of the distributor. The deflectors are configured to direct gas flow exiting the distributor in an essentially perpendicular direction to the direction of gas flow entering the distributor.

In another preferred embodiment, the invention provides a gas distributor having an inlet end and a terminal end and containing spatially separate first and second substantially parallel side walls. A plurality of deflectors are disposed between the side walls, each deflector having a first side and an opposing side wherein the first and opposing sides are attached to the first and second side walls respectively. The deflectors are separately spaced along the side walls relative to one another in a plane that cuts diagonally across a gas flow path in a gas flow direction from the inlet end of the distributor to the terminal end of the distributor. The deflectors are oriented to effectively cut and distribute gas in a direction substantially perpendicular to the direction of gas flow entering the distributor at the inlet end. Furthermore, the amount of gas in each cut from the inlet end to the terminal end of the distributor is substantially the same.

To further illustrate the features and advantages of the invention, reference is made to FIGS. 1–5 wherein like numbers represent like features.

Figure 1:
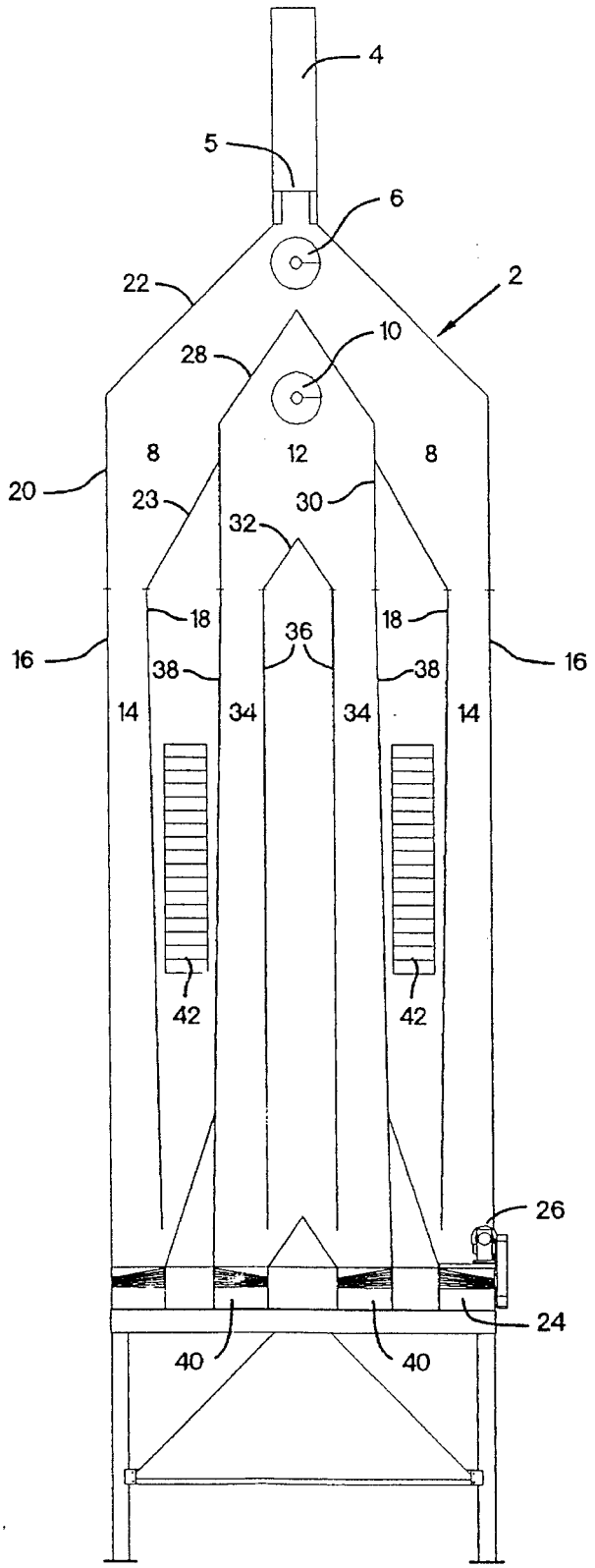
FIG. 1 is a cross-sectional, elevational view, not to scale illustrating a cross-flow dryer containing the gas distributors of the invention.
Figure 2:
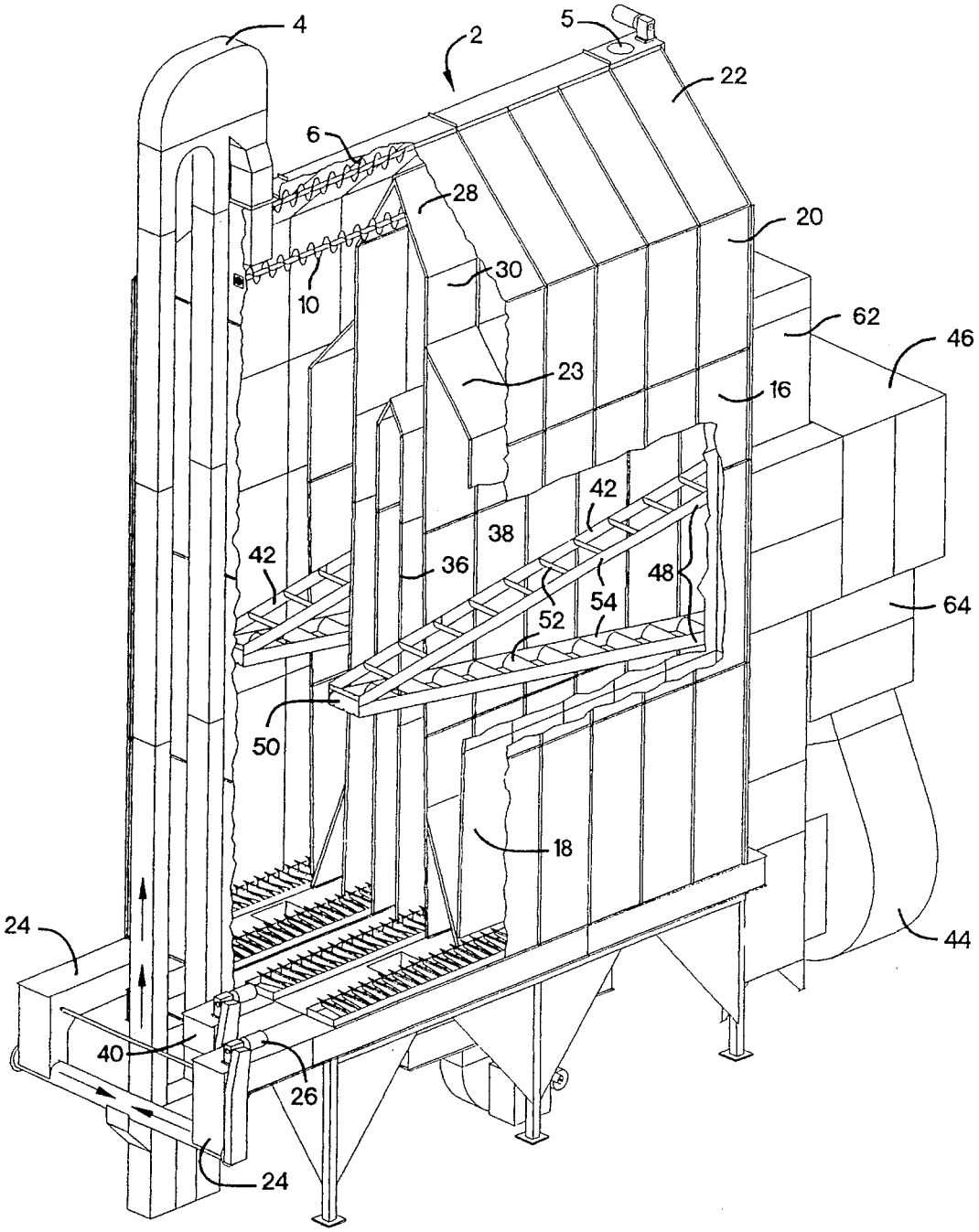
FIG. 2 is a perspective cut away view, not to scale, illustrating a cross-flow dryer containing the gas distributors of the invention.

FIG. 1 is a cross-sectional, elevational view of a particulate dryer 2 having a particulate material inlet 5 for feed of particulate material to be dried into a particulate material distribution feeder 6. The distribution feeder 6, for example an auger, distributes the particulate material across the width of the dryer 2 as illustrated in FIG. 2 into an outer holding zone 8 having solid panel walls 20, 22, 23, 28, and 30 for entry into the outer drying chambers 14 formed by foraminous outer wall 16 and foraminous inner wall 18. Particulate material flows vertically between the outer wall 16 and the inner wall 18 from the top portion of the dryer to a bottom portion of the dryer. Partially dried particulate material that collects at the bottom of outer drying chamber 14 is conveyed by conveyor 24 driven by motor 26 into a particulate material lift conveyor 4 whereby it is then discharged near the top portion of the dryer into a second distribution feeder 10 which distributes particulate material across the width of the dryer as illustrate in FIG. 2 into the inner holding zone 12 bounded by solid panel walls 28 and 30. Center inclined panels 32 distribute the particulate material into the inner drying chambers 34 which are formed on each side of inner foraminous panels 36 and outer foraminous panels 38. As the partially dried particulate material flows vertically downward through the inner drying chambers 34, the particulate material is dried further and collects at the bottom of the inner drying chambers 34. Dried particulate material is then conveyed out of the dryer 2 to storage by conveyors 40.

In order to provide for a more uniform and less restricted flow of particulate material through outer drying chambers 14, foraminous walls 18 and 38 are preferably not parallel, but are inclined slightly from the top to the bottom so that the bottom of each drying chamber 14 and 34 is wider than the top of each drying chamber and the distance between foraminous walls 18 and 38 is greater above the distributor 42 than below the distributor. In this manner, the gas exiting the distributor between foraminous walls 18 and 38 is less restricted in the upper portion of the dryer (wherein the particulate material is wetter) than in the lower portion of the dryer (wherein the material tends to be dryer). Accordingly, the drying gas through each drying chamber 14 and 34 is more readily controlled over the entire height of the dryer.

Gas distributors 42 of the invention, distribute the drying gas through foraminous walls 18 and 38 on opposing sides of the distributor 42 into the particulate material to be dried. After passing through the particulate material, the drying gas exits the dryer through foraminous walls 16 and 36 to the atmosphere.

As illustrated in FIG. 2, the gas distributor 42 is positioned between foraminous walls 38 and 18 so that it distributes the gas from blower 44 and inlet gas plenum 46 evenly across the width of the dryer from an inlet end 48 to a terminal end 50 of the distributor. A plurality of deflectors 52 may be affixed to the foraminous walls 18 and 38 or they may be attached to elongate members 54 which lie in planes cutting diagonally across a gas flow path in a direction from the inlet end 48 of the distributor 42 to a terminal end 50 of the distributor. Although it is preferred to have deflectors 52 disposed in first and second planes which are oriented relative to the gas flow direction so that the planes cut diagonally across the gas flow path and intersect at their respective terminal ends 50, it will be recognized that, for some applications, deflectors 52 may be disposed in a single plane cutting diagonally across the gas flow path exiting the inlet gas plenum 46 from the inlet end 48 to the terminal end 50 of the distributor. When the deflectors are disposed in first and second intersecting planes, it is preferred to have the distributor located near the mid section of the dryer in order to distribute the drying gas more evenly throughout the upper and the lower portions of the dryer 2.

Figure 3:
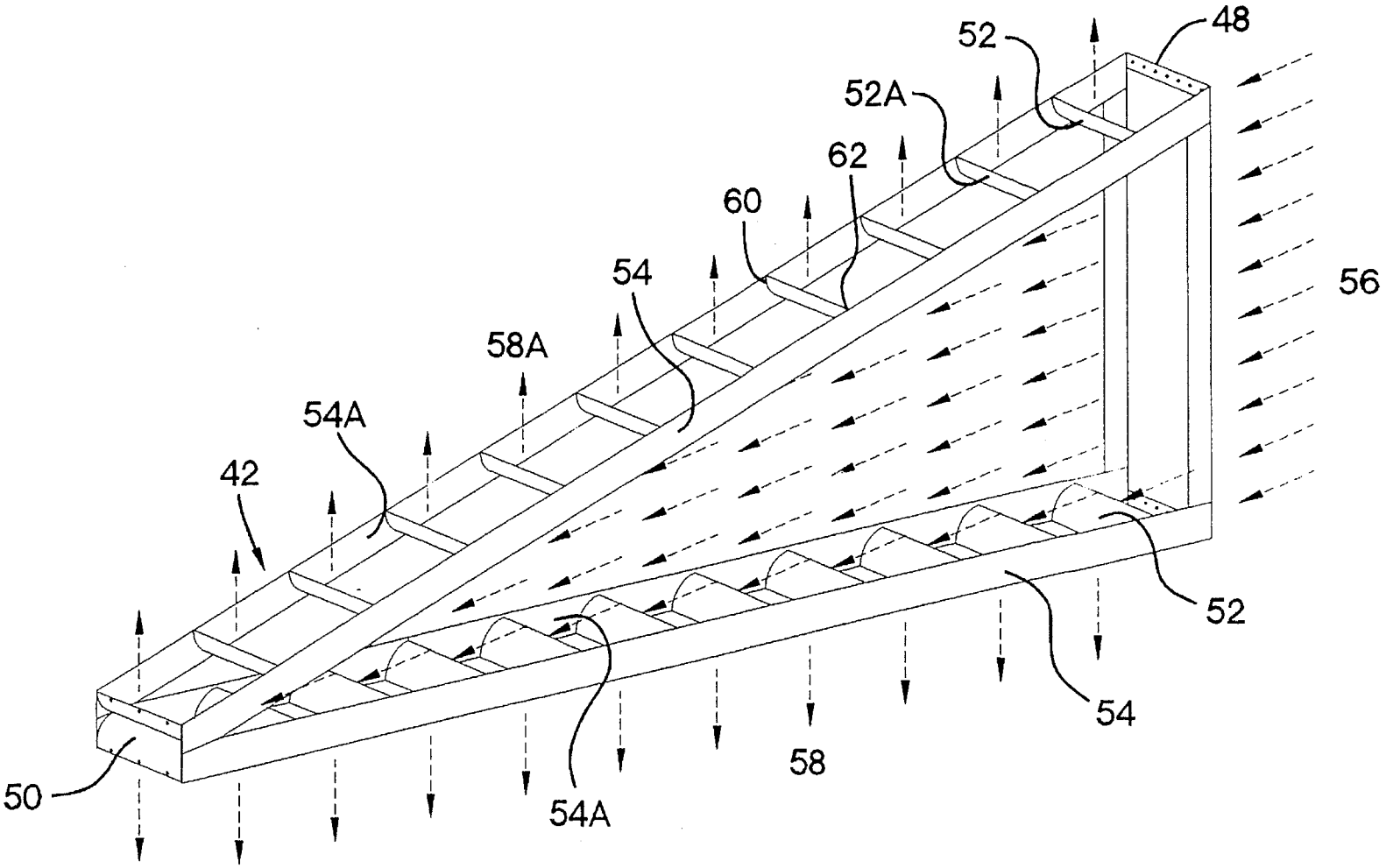
FIG. 3 is a perspective view, not to scale of a gas distributor of the invention.

A particularly preferred embodiment of the gas flow distributor 42 is illustrated in a perspective view in FIG. 3. As illustrated in FIG. 3, gas enters the distributor at the inlet end 48 of the distributor as represented by arrows 56. As the gas travels from the inlet end 48 to the terminal end 50 of the distributor, portions of the gas are deflected by a plurality of deflectors 52 so that the gas flow is directed substantially perpendicular to the direction of flow 56 as represented by arrows 58 and 58*a*.

For ease of construction, the gas distributor 42 may be comprised of deflectors having first sides 60 and opposing sides 62 for attachment between parallel elongate members 54 and 54*a*. The deflectors 52 are preferably fixedly attached so that their orientation relative to the gas flow cannot change. In the alternative, the deflectors may be attached to the elongate members 54 and 54*a* so that the angle of deflection can be adjusted relative to the gas flow entering the distributor.

Adjacent deflectors 52 and 52*a* may be variably spaced along elongate members 54 and 54*a* from the inlet end 48 to the terminal end 50 thereby providing a means to vary the distribution of gas from the inlet end to the terminal end of the distributor. It is preferred, however, that the spacing between adjacent deflectors 52 and 52*a*, for example, provide a continuum of gas flow deflection in a direction substantially perpendicular to the direction of gas flow from the inlet end 48 to the terminal end of the distributor so that the amount of drying gas distributed from the inlet end to the terminal end along the distributor is essentially the same.

Figure 4:
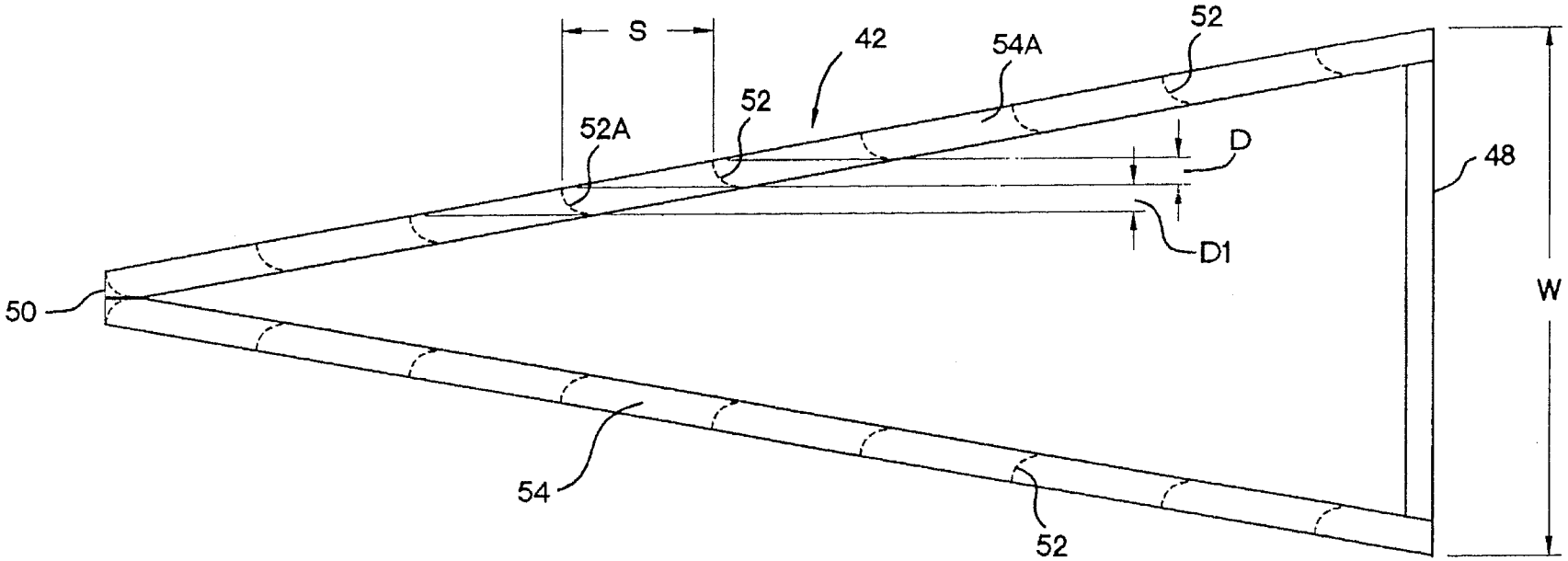
FIG. 4 is a cross-sectional view, not to scale, illustrating the orientation of the deflectors of the gas distributor.
Figure 5:
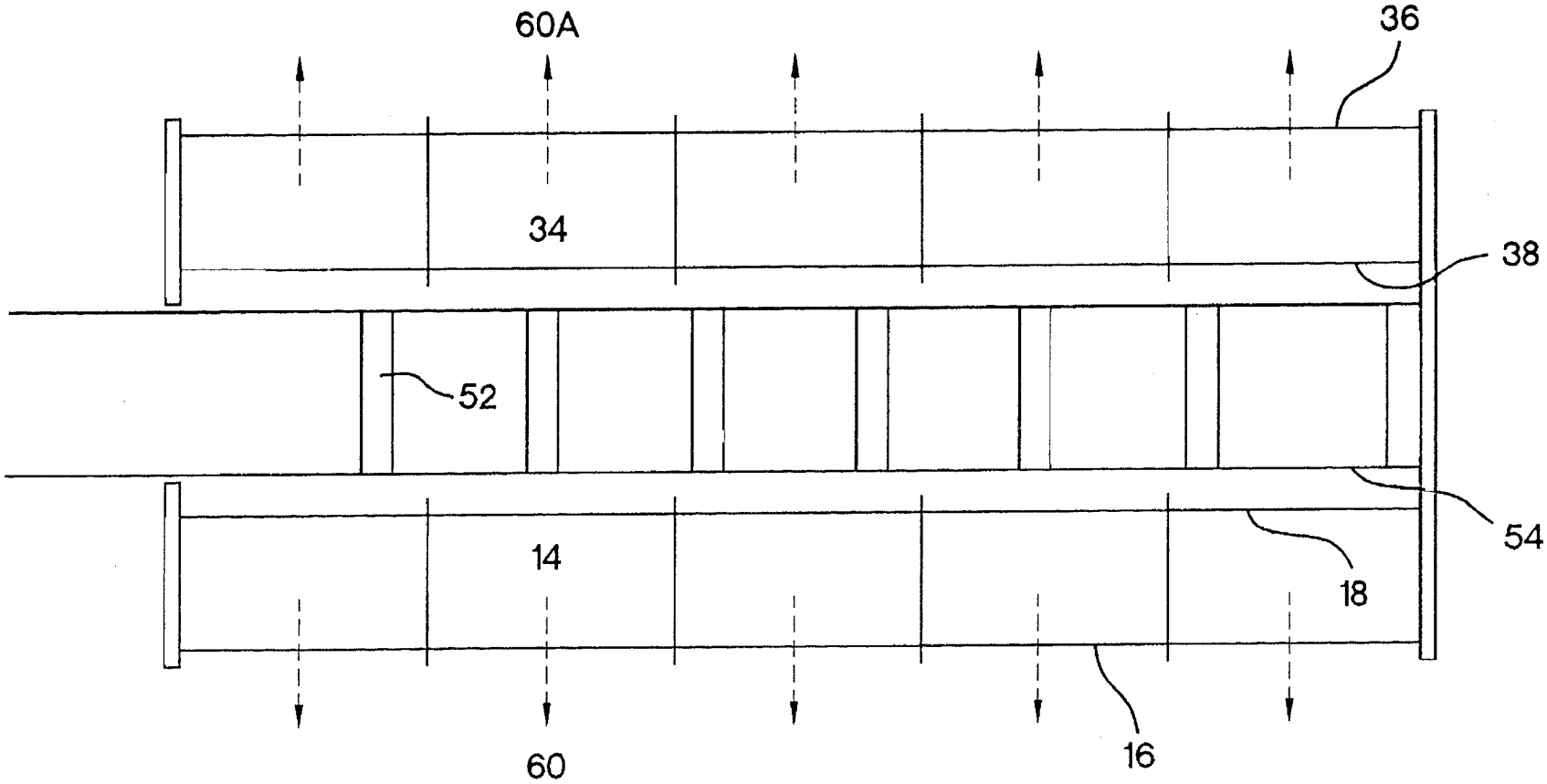
FIG. 5 is a vertical plan view, not to scale, illustrating the direction of gas flow exiting a gas distributor of the invention.

FIG. 4 illustrates the preferred configuration of deflectors 52 shown in outline in a cross-sectional view of distributor 42. As illustrated, the deflectors 52 are preferably arcuate members forming a 90° arc of a circle so that the concave side of each arc generally faces the inlet end 48 of the distributor. The deflectors can be other shapes which effectively provide similar gas flow deflection, such as two or more planar panels joined at obtuse angles with one another, however, a smooth arc is preferred for minimizing the pressure drop across the distributor. For arcuate deflectors, the length of each arcuate member is preferably between about 4 to 8 inches most preferably about 6 inches.

Since the deflectors 52 are disposed in planes cutting diagonally across the direction of gas flow, portions of the flowing gas stream can be cut and deflected above and below the distributor in substantially perpendicular directions relative to the direction of gas flow entering the distributor as illustrated in FIG. 3.

The spacings of adjacent deflectors 52 and 52*a* is related to the width W of the distributor 42 and the length of each deflector 52. With reference to FIG. 4, the deflectors 52 and 52*a* are spaced along elongate member 54*a* so that the top of deflector 52*a* does not overlap the gas flow deflected by adjacent deflector 52 and so that each deflector captures a portion of gas represented by D and D1 whereby D and D1 are substantially equal. While the preferred spacing is as determined above, more or fewer deflectors may be used along elongate members 54 and 54*a*, however an increase in the number of deflectors may increase the overall pressure drop through the distributor without any added benefit to particulate drying. Likewise the use of fewer deflectors may reduce the even air distribution thus adversely affecting the particulate drying. Hence it is most preferred to space the deflectors as illustrated in FIG. 4 so that the entire width W of gas flow entering the distributor 42 is directed substantially perpendicular to the direction of gas flow.

As the gas exits the distributor from deflectors 52, the gas passes through foraminous walls on 18 and 38 (FIGS. 1 and 5) in the direction of gas flow indicated by arrows 60 and 60*a* so that it passes though the particulate material in inner drying chamber 34 and outer drying chamber 14 in order to dry the particulate material. After passing through the particulate material, the drying gas 60 and 60*a* exits to the atmosphere through foraminous walls 16 and 36.

In an alternative embodiment, the drying gas exiting through foraminous walls 36 may be collected in center collection duct 62 for recycle to the inlet of blower 44 (FIG. 2). Additional heated gas may be added to the inlet of the blower 44 from an external source, or by means of a heating section 64 containing a burner or other direct or indirect gas heating means which may be positioned at the discharge of the blower between the blower and the inlet gas plenum 46.

The distributor of the invention is particularly useful for evenly distributing drying gas when the gas flow is in the range of from about 2250 SCFM to about 3500 SCFM. Higher or lower gas flows may be used, however, the distributor may be less efficient for gas flows outside of the preferred range.

Having described the invention and its preferred embodiments, variations of the inventions are well within the spirit and scope of the appended claims. Accordingly, the distributor of the invention can be oriented in an inlet gas plenum so that it distributes gas in either a vertical direction or a horizontal direction relative to the direction of gas exiting the distributor.

What I claim is:

1. A dryer for particulate material comprising a chamber for drying said particulate material, said chamber having a particulate material inlet, a particulate material outlet, a drying gas inlet and an exhaust gas outlet, said inlet containing a gas distributor for conducting gas in a flow direction along a flow path from an inlet end to a terminal end of the distributor said distributor containing a plurality of gas deflectors spaced apart to slice diagonally across the gas flow path in a gas flow direction from the inlet end of the distributor to the terminal end of the distributor, said deflectors being oriented to direct gas flow exiting the distributor in a direction transverse to the direction of gas flow entering the distributor.

2. The dryer of claim 1 containing a plurality of gas inlets, each gas inlet containing a gas distributor.

3. The dryer of claim 1 having a cross-flow configuration for drying particulate material wherein the gas inlet and gas distributor are horizontally oriented relative to a vertical direction of particulate material flow through the dryer.

4. The dryer of claim 1 wherein the deflectors are arcuate members.

5. The dryer of claim 4 wherein each arcuate member forms about a 90° arc of a circle.

6. The dryer of claim 1 wherein the gas distributor further comprises first and second planes having inlet ends and terminal ends which planes are diagonally oriented relative to the gas flow direction so that the planes intersect at their respective terminal ends and diverge at their respective inlet ends, wherein said deflectors are disposed in said diagonally oriented planes.

7. The dryer of claim 6 wherein the dryer is a cross-flow dryer and the gas distributor is oriented so that it directs the drying gas vertically above and below the distributor through foraminous members to dry particulate material in said chamber.

8. The dryer of claim 1 further comprising one or more foraminous walls adjacent to the chamber for receiving gas therethrough as it exits the distributor.

9. The dryer of claim 1 wherein each deflector is spaced relative to an adjacent deflector such that the spacing between adjacent deflectors provides a continuum of gas flow deflection in a direction perpendicular to the direction of gas flow through the distributor.

10. A gas distributor for an inlet gas plenum for conducting gas in a flow direction along a flow path from an inlet end to a terminal end said distributor comprising a plurality of gas deflectors spaced apart to slice diagonally across the gas flow path in a gas flow direction from the inlet end of the distributor to the terminal end of the distributor, said deflectors being oriented to direct gas flow exiting the distributor in a direction transverse to the direction of gas flow entering the distributor.

11. The distributor of claim 10 wherein the deflectors are arcuate members.

12. The distributor of claim 11 wherein each arcuate member forms about a 90° arc of a circle.

13. The distributor of claim 10 wherein each deflector is spaced relative to an adjacent deflector such that the spacing between adjacent deflectors provides a continuum of gas flow deflection in a direction perpendicular to the direction of gas flow through the distributor.

14. The distributor of claim 10 further comprising a first and second rigid elongate member each having inlet ends and terminal ends, the first and second members being disposed in separate diagonally oriented planes relative to the gas flow direction so that the planes intersect at the terminal ends of each member and diverge at the inlet ends of each member wherein said deflectors are disposed in spaced apart relationship along said rigid members from the inlet end to the terminal end of each rigid member.

15. The distributor of claim 14 wherein each deflector is spaced relative to an adjacent deflector on the same rigid member such that the spacing between adjacent deflectors provides a continuum of gas flow deflection in a direction perpendicular to the direction of gas flow through the distributor.

16. A gas distributor having an inlet end and terminal end, said distributor comprising spatially separate first and second substantially parallel side walls and a plurality of deflectors disposed between the side walls, each deflector having a first side and an opposing side, said first and opposing sides being attached to the first and second side walls respectively, said deflectors being separately spaced relative to one another in a plane which plane cuts diagonally across a gas flow path in a gas flow direction from the inlet end of the distributor to the terminal end of the distributor, and said deflectors have an orientation relative to the direction of gas flow sufficient to cut and distribute gas in a direction substantially perpendicular to the direction of gas flow entering the distributor at the inlet end whereby the amount of gas in each cut from the inlet end to the terminal end of said distributor is substantially the same.

17. The distributor of claim 16 wherein the deflectors are arcuate members.

18. The distributor of claim 17 wherein each arcuate member forms about a 90° arc of a circle.

19. The distributor of claim 16 wherein each deflector is spaced relative to an adjacent deflector such that the spacing between adjacent deflectors provides a continuum of gas flow deflection in a direction perpendicular to the direction of gas flow through the distributor.

20. The distributor of claim 16 wherein the side walls are formed from foraminous materials for flow of gas from the distributor therethrough.

21. The distributor of claim 16 further comprising first and second planes having inlet ends and terminal ends which planes are diagonally oriented relative to the gas flow direction so that the planes intersect at their respective terminal ends and diverge at their respective inlet ends, wherein said deflectors are disposed in said first and second planes between said side walls to divide a gas flow essentially evenly between the first and second planes.

* * * * *